US009074601B1

(12) United States Patent
Thut

(10) Patent No.: US 9,074,601 B1
(45) Date of Patent: Jul. 7, 2015

(54) PUMP FOR PUMPING MOLTEN METAL WITH REDUCED DROSS FORMATION IN A BATH OF MOLTEN METAL

(71) Applicant: Bruno Thut, Chagrin Falls, OH (US)

(72) Inventor: Bruno Thut, Chagrin Falls, OH (US)

( * ) Notice: Subject to any disclaimer, the term of this patent is extended or adjusted under 35 U.S.C. 154(b) by 0 days.

(21) Appl. No.: 14/156,883

(22) Filed: Jan. 16, 2014

(51) Int. Cl.
*F04D 7/06* (2006.01)
*F27D 3/14* (2006.01)

(52) U.S. Cl.
CPC . *F04D 7/065* (2013.01); *F27D 3/14* (2013.01)

(58) Field of Classification Search
CPC ..... F04D 7/065
USPC ..... 417/423.3, 423.11, 423.14, 424.1; 75/682–684; 266/236, 237, 239
See application file for complete search history.

(56) References Cited

U.S. PATENT DOCUMENTS 2,468,704 A * 4/1949 Pippin ..... 417/423.12
4,169,584 A * 10/1979 Mangalick ..... 266/214
4,940,384 A * 7/1990 Amra et al. ..... 415/121.2
5,676,520 A * 10/1997 Thut ..... 415/121.3
5,716,195 A * 2/1998 Thut ..... 417/53
6,187,096 B1 * 2/2001 Thut ..... 118/300
6,524,066 B2 * 2/2003 Thut ..... 415/200
7,476,357 B2 * 1/2009 Thut ..... 266/239
7,534,284 B2 * 5/2009 Thut et al. ..... 75/684
7,858,020 B2 * 12/2010 Thut ..... 266/142
2011/0142606 A1 * 6/2011 Cooper ..... 415/200

* cited by examiner

*Primary Examiner* — Peter J Bertheaud
(74) *Attorney, Agent, or Firm* — Pearne & Gordon LLP

(57) ABSTRACT

A pump for pumping molten metal includes a refractory base that can be submerged in a bath of molten metal. A refractory shaft sleeve has upper and lower end portions and is fastened to the base at the lower end portion. The shaft sleeve is enclosed at the upper end portion and includes openings at a lower end portion. The base includes an impeller chamber that is in fluid communication with the shaft sleeve and includes an outlet from the impeller chamber. The pump includes a motor. A refractory shaft extends in the shaft sleeve and is connected to the motor. A refractory impeller is connected to the shaft and is rotatable in the impeller chamber of the base. A gas source flows gas comprising inert gas into the shaft sleeve under pressure. A regulator regulates at least one of flow rate and pressure of the gas so as to avoid cavitation of the pump while outletting the gas through the openings of the shaft sleeve. Also featured is a method of operating a pump for pumping molten metal including regulating at least one of flow rate and pressure of the gas effective to prevent cavitation of the pump while outletting the gas through the openings in the shaft sleeve.

29 Claims, 5 Drawing Sheets

PUMP FOR PUMPING MOLTEN METAL WITH REDUCED DROSS FORMATION IN A BATH OF MOLTEN METAL

TECHNICAL FIELD

This disclosure pertains to a pump for pumping molten metal of the type used in a bath of molten metal leading to a furnace or hearth and to reducing dross in the molten metal.

TECHNICAL BACKGROUND

Pumps for pumping molten metal of the type that include a motor driven impeller typically position the impeller on the end of a shaft inside an impeller chamber of an elongated base having an inlet and outlet from the impeller chamber. Upon rotation of the impeller, molten metal is drawn into the base into the impeller chamber and then travels to the outlet of the base. If the pump is a circulation or submerged discharge pump, the outlet of the base extends as a passageway to the outer surface of the base, which circulates the molten metal through a furnace or hearth, for example. If the pump is a transfer pump, the outlet can lead to a riser spaced apart from the shaft, which extends above the pump to a conduit which directs the molten metal to another location such as to a ladle or to a die casting machine. All of the components of the pump that are in the molten metal environment are typically made of refractory material such as graphite, ceramic, graphite with a ceramic covering or graphite impregnated with a refractory oxide.

Pumps of the type that include a base have been designed with a refractory shaft sleeve that extends between the motor support plate and the base. The shaft rotates inside the sleeve. Gas has been added into the shaft sleeve as disclosed in U.S. Pat. No. 5,676,520, and displaced the molten metal inside. However, this can lead to cavitation of the pump as it can be difficult to control the gas.

A straining member has been used with such pumps having openings that prevent debris from entering the inlet. In addition, shaft sleeves, including those of U.S. Pat. No. 5,676,520, have been formed with openings that permit entry of molten metal into the shaft sleeve and then into the base.

The field of molten metal pumping suffers from a problem of dross formation. Dross includes oxides of the molten metal, such as aluminum oxide in molten aluminum processing. The dross is periodically skimmed from a surface of the bath by a worker in a dangerous, labor intensive procedure. The dross formation increases due to agitation of the molten metal such as that occurring during pumping, and exposure of the metal to oxygen in the air. Remaining amounts of the dross can cause a reduction in the quality of the metal parts that are formed from the molten metal. Therefore, it has long been desired, but not yet satisfactorily achieved, to pump molten metal in a bath having reduced dross formation.

BRIEF DESCRIPTION

A first embodiment of the disclosure features a pump for pumping molten metal. The pump includes a refractory base that can be submerged in a bath of molten metal. A refractory shaft sleeve has upper and lower end portions and is fastened to the base at the lower end portion. The shaft sleeve is enclosed at the upper end portion and includes openings at a lower end portion. The base includes an impeller chamber that is in fluid communication with the shaft sleeve and includes an outlet from the impeller chamber. The pump includes a motor. A refractory shaft extends in the shaft sleeve and is connected to the motor. A refractory impeller is connected to the shaft and is rotatable in the impeller chamber of the base. A gas source flows gas comprising inert gas into the shaft sleeve under pressure. A regulator regulates at least one of flow rate and pressure of the gas so as to avoid cavitation of the pump while outletting the gas through the openings of the shaft sleeve.

The following refers to specific features that can be used in the first embodiment. The openings can include first openings located near the base and second openings, wherein upper surfaces of the second openings are disposed above upper surfaces of the first openings. The regulator can regulate the gas so that the gas that is outlet from the shaft sleeve through the openings travels into the bath so as to reduce formation of dross in the molten metal. The first openings can be inlet openings through which molten metal enters the shaft sleeve and the second openings can be outlet openings through which the gas is outlet from the shaft sleeve. The second openings can be positioned so as to be circumferentially offset from the first openings in a top cross-sectional view. The second openings can be constructed and arranged so as to be completely above the first openings with a vertical space between the first and second openings. The second openings can be constructed and arranged so as to overlap a region of the shaft sleeve in which the first openings are disposed.

As to more specific features of the first embodiment, the impeller can be a top feed impeller, a bottom feed impeller or a top and bottom feed impeller. There can be an opening in a bottom of the base that is partially blocked by the impeller so that the molten metal enters the impeller chamber through openings in the impeller.

Yet another specific feature is that the regulator can maintain the molten metal inside the shaft sleeve at a desired level despite changing conditions selected from the group consisting of: level of submergence of the base in the bath, level of molten metal in the bath, speed of the motor and combinations thereof.

Still further, the openings can all have a uniform size or shape or the openings can have different sizes (and or shapes) than each other.

In another feature the pump includes a plurality of the openings disposed in a region of the shaft sleeve that extends around a circumference of said shaft sleeve for a vertical distance of said shaft sleeve (e.g., in a uniform pattern), whereby the molten metal enters said shaft sleeve through said openings in a first lower portion of said region and the gas is outlet from the shaft sleeve through said openings in a second upper portion of the region. These openings can all have a uniform size or shape or different sizes (and or shapes) than each other.

The specific features of the first embodiment may be used in any combination. In addition, any features described in the Detailed Description below may be used in the first embodiment in any combination, including in combination with the above specific features.

A second embodiment features a method of operating a pump for pumping molten. The pump is as described above in the first embodiment. The method includes submerging the base in a bath of molten metal. The motor is operated so as to rotate the impeller via the shaft. The molten metal is moved into the impeller chamber and from the outlet of the base as a result of the impeller rotating in the impeller chamber. Gas flows down the shaft sleeve. At least one of flow rate and pressure of the gas is regulated effective to prevent cavitation of the pump while outletting the gas through the openings in the shaft sleeve.

The following refers to specific features that might be used in the second embodiment. The regulation of the gas that outlets the gas through the openings in the shaft sleeve can reduce dross formation in the bath. In another feature, the dross formation can be reduced by outletting the gas into the bath effective to form a cover layer of the gas on or near a surface of the bath that reduces the formation of dross in the bath.

Yet another feature is that the openings in the shaft sleeve can include first openings located near the base and second openings, wherein upper surfaces of the second openings are disposed above upper surfaces of the first openings, including feeding the molten metal into the shaft sleeve through the first openings and outletting the gas from the shaft sleeve through the second openings. Still further the regulation of the gas can cause a level of molten metal inside the shaft sleeve to be located below the upper surface of the second openings (or below an upper surface of the uppermost openings). The regulation of the gas can maintain the molten metal inside the shaft sleeve at a desired level despite changing conditions selected from the group consisting of: level of submergence of the base in the bath, level of molten metal in the bath, speed of the motor and combinations thereof. In another feature the second openings can be constructed and arranged so as to be completely above and vertically spaced apart from the first openings. The second openings can be constructed and arranged so as to overlap a region of the shaft sleeve in which the first openings are disposed.

Still further, the openings can all have a uniform size or shape or the openings can have different sizes (and or shapes) than each other.

In another feature the pump includes a plurality of the openings disposed in a region of the shaft sleeve that extends around a circumference of the shaft sleeve for a vertical distance of the shaft sleeve, comprising moving the molten metal into the shaft sleeve through the openings in a first lower portion of the region and moving the gas out the shaft sleeve through the openings in a second upper portion of the region. These openings can all have a uniform size or shape or the openings can have different sizes (and or shapes) than each other.

In another feature the gas regulator enables at least one of flow rate and pressure of the gas to be regulated such that a level of the molten metal in the shaft sleeve is disposed (e.g., and maintained despite varying conditions) at a desired level below an upper surface of the second openings (or even below a lower surface of the second openings) but so as to avoid cavitation of the pump. For example, the molten metal level inside the shaft sleeve may be at a level that is ¾ of a height up from the lower surface of the second openings, ½ of the height up from the lower surface of the second openings, in between the first and second openings, above an upper surface of the first openings, ¾ of a height up from the lower surface of the first openings, or ½ of the height up from the lower surface of the first openings. The desired level is able to be maintained by the fine control of the regulator, despite changing conditions selected from the group consisting of: level of submergence of the base, level of molten metal in the bath, speed of the motor and combinations thereof. Other changing factors could also exist that the regulator could manage, depending on the application, such as change in molten metal flow resulting from change between transfer and circulation functions in a multifunctional pump. It should be appreciated that changing the level of the molten metal inside the shaft sleeve (or pressure or flow rates) by the use of the gas regulator can affect the amount of gas that leaves the shaft sleeve. For example, the level could be disposed at certain locations of the openings resulting in more or less gas outletting the shaft sleeve as desired.

The specific features of second embodiment can be used in any combination. These features can be combined with features of the first embodiment and/or with any of the features described in the Detailed Description below.

It should be understood that the above Brief Description describes embodiments of the disclosure in broad terms while the following Detailed Description describes embodiments of the disclosure more narrowly and presents specific embodiments that should not be construed as necessary limitations of the invention as broadly defined in the claims. Many additional features, advantages and a fuller understanding of the invention will be had from the accompanying drawings and the Detailed Description that follows.

DETAILED DESCRIPTION

Figure 1:
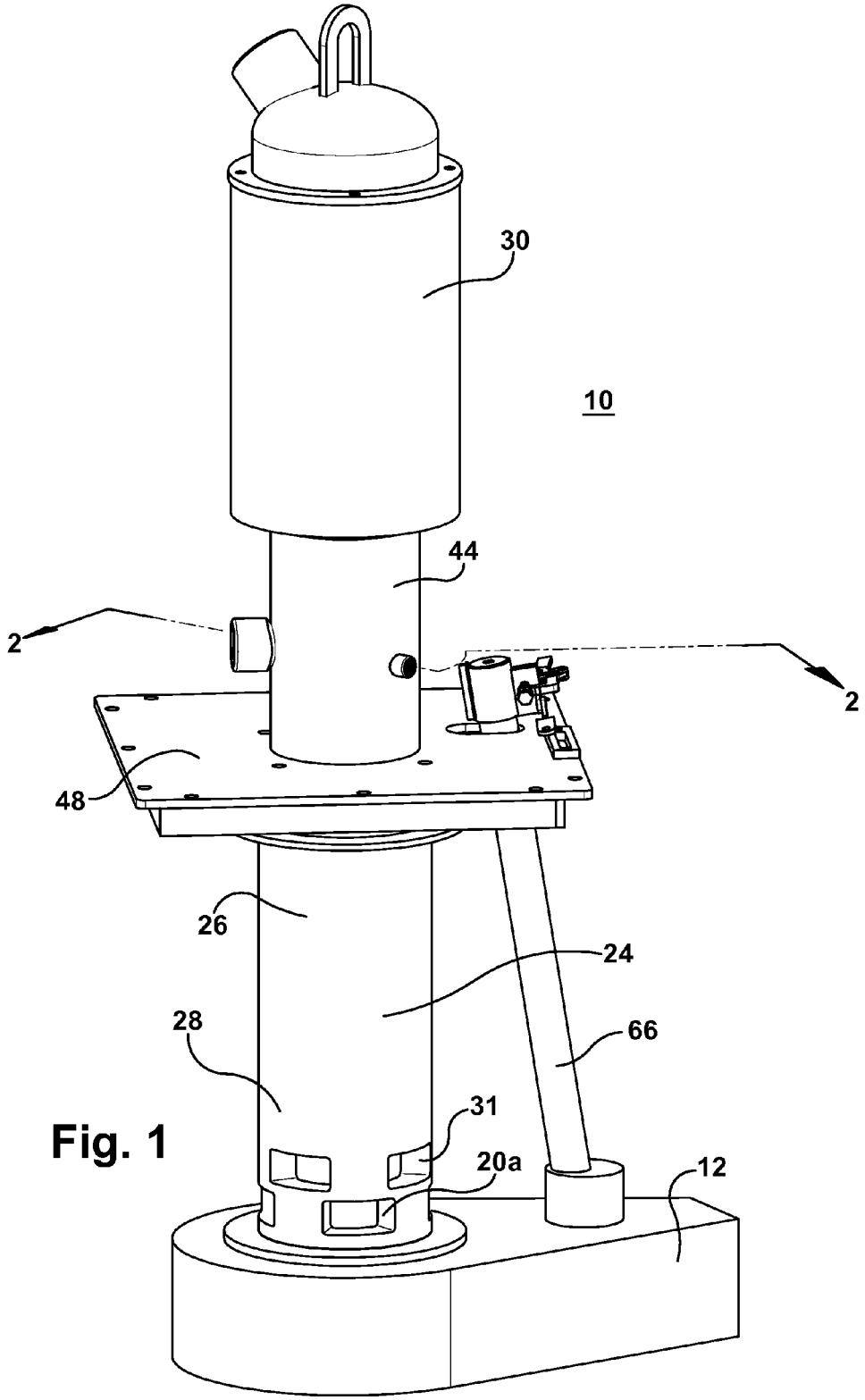
FIG. 1 is a perspective view of an example of a pump according to this disclosure.
Figure 2:
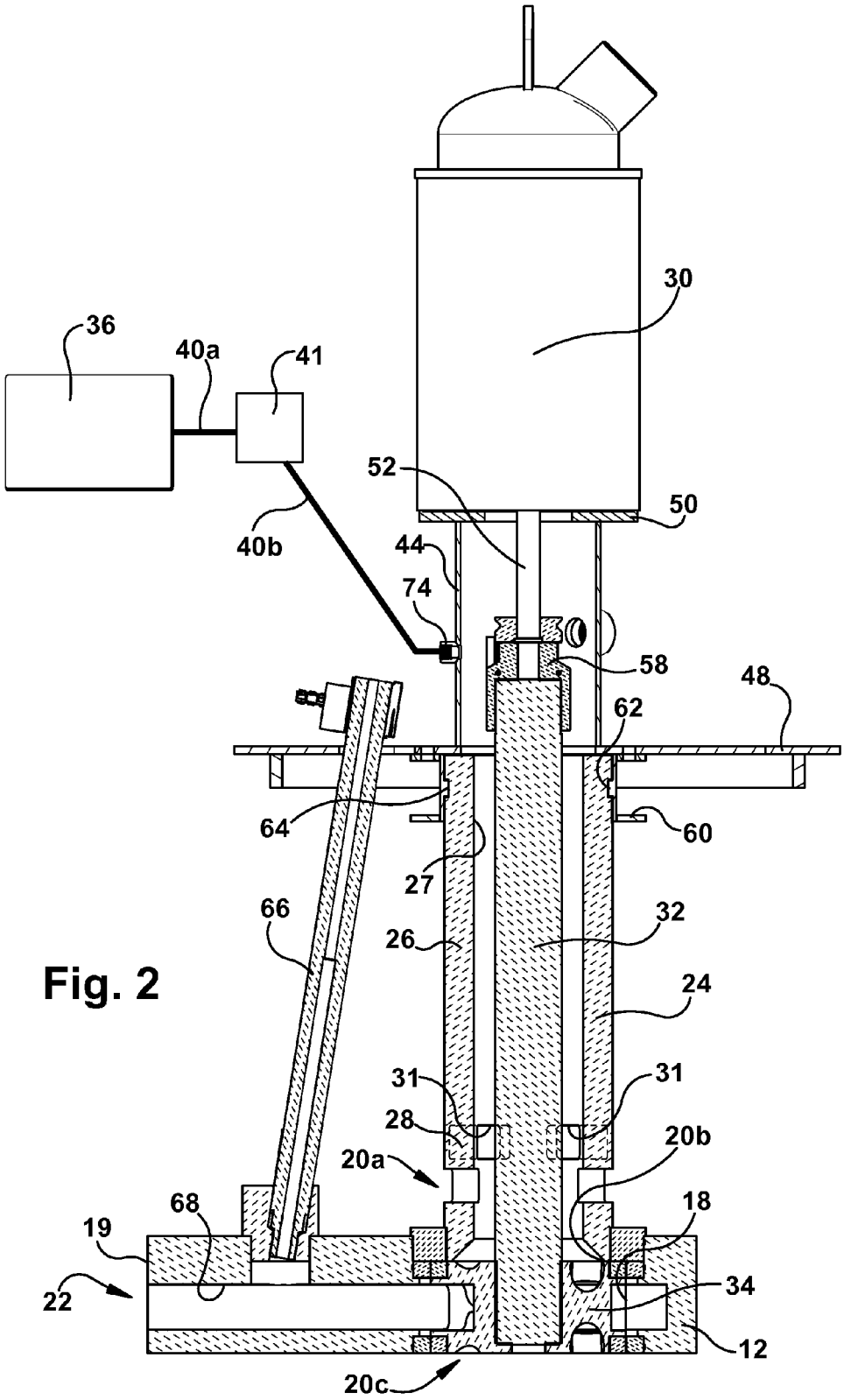
FIG. 2 is a vertical cross-sectional view of the pump of FIG. 1.
Figure 3:
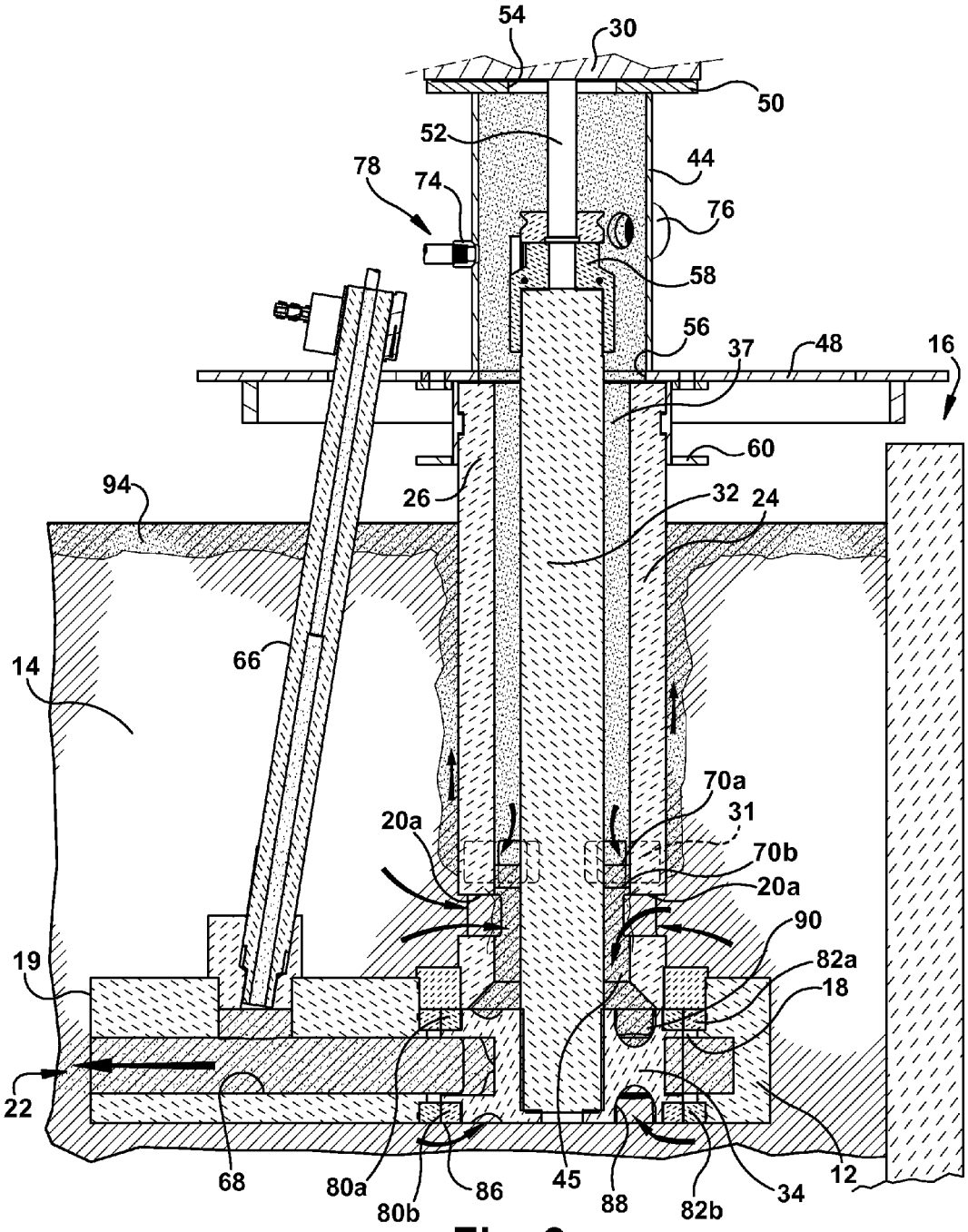
FIG. 3 is a vertical cross-sectional view showing the pump operating with the use of gas under pressure in the shaft sleeve.
Figure 4:
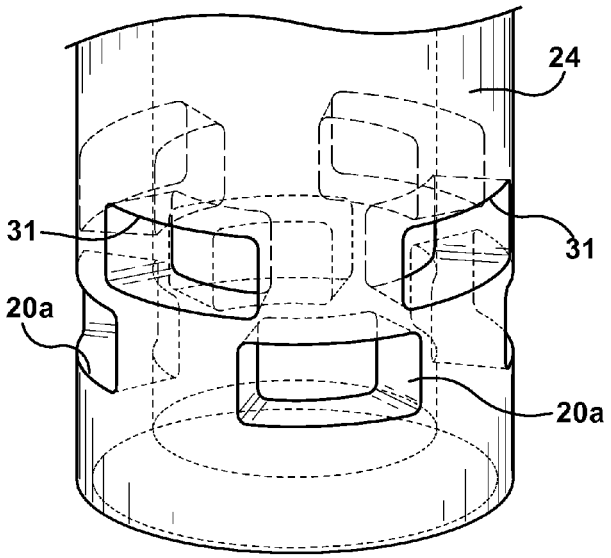
FIGS. 4-8 are views showing variations of the shaft sleeve openings including: first and second vertically spaced openings (FIG. 4); one set of openings (FIG. 5), first and second vertically overlapping openings (FIG. 6); triangular shaped openings (FIG. 7) and a plurality of openings (FIG. 8), respectively.

Referring to FIGS. 1-3, the pump 10 for pumping molten metal includes the following features. A base 12 is submerged in a bath of molten metal 14 contained in a vessel 16 and includes an impeller chamber 18 and an outlet 22 from the impeller chamber. A refractory shaft sleeve 24 has upper and lower end portions 26, 28, respectively, and is fastened to the base 12 at its lower end portion 28. The shaft sleeve is in the form of a hollow cylinder or tube having a central passageway 27 through it. The base can include an upper opening 20*b* adjacent the shaft sleeve. Also, molten metal can enter the impeller chamber through lower opening 20*c*, for example, in the top and bottom feed pump shown. The impeller chamber 18 is in fluid communication with the passageway 27 of the shaft sleeve. Openings are formed in the shaft sleeve (e.g., openings 20*a* shown in FIGS. 1-4) permitting gas outlet and optionally molten metal inlet. The shaft sleeve can be fastened to the base in a variety of ways, only one example being shown in the drawings, such as the use of a shoulder that receives the lower end portion of the shaft sleeve.

A motor 30 (e.g., air or electric motor) is disposed above the upper end portion 26 of the shaft sleeve 24. A refractory shaft 32 extends in the shaft sleeve 24 and is connected to the motor near the upper end portion 26 of the shaft sleeve. A refractory impeller 34 is connected to the refractory shaft 32 and is rotatable in the impeller chamber 18 of the base 12. The impeller can include vanes, perforations, a combination of these, or other design. The shaft sleeve 24 is enclosed at the upper end portion 26 thereof as will be described below. A gas source 36 (e.g., a tank of pressurized inert gas) is connected to or near the upper end portion of the shaft sleeve 24 and flows gas into the shaft sleeve under pressure. Conduit 40*a* leads from the gas source 36 to a pressure and/or flow regulator(s)

41 of the gas while conduit 40*b* extends from the regulator(s) 41 to the upper tube 44 of the pump. The gas travels down the shaft sleeve and out openings in the shaft sleeve (e.g., upper openings 31 and optionally out a portion of lower openings 20*a* in the example shown in FIGS. 1-4). Gas might enter the impeller chamber of the pump and flow along with the molten metal through the outlet 22 into the bath. However, while not wanting to be bound by theory, it is believed that most, or substantially all, of the gas may exit the shaft sleeve through the openings (e.g., through upper openings 31 and optionally out a portion of lower openings 20*a*). The proportion of gas that leaves through the openings of the shaft sleeve compared to through the outlet 22, may depend on factors including the height of the molten metal in the shaft sleeve, gas pressure and/or flow rate, motor speed, and on the position and size of the openings in the shaft sleeve.

The pump includes a motor mount base plate 48. A motor adapter plate 50 is spaced above the motor mount base plate 48. The upper tube 44 extends between the motor mount base plate 48 and the motor adapter plate 50. The motor mount base plate 48, the motor adapter plate 50 and the upper tube 44 can be composed of metal, for example, steel, and can be fastened together in a known manner such as by welding. The motor 30 is affixed on the adapter plate 50. A drive shaft 52 of the motor 30 extends into an opening 54 in the motor adapter plate 50. The opening 54 is aligned with an opening 56 in the motor mount base plate 48 (FIG. 3). A coupling 58 as is known in the art and shown only generally in the drawings, connects the motor drive shaft 52 and the pump shaft 32 together and is disposed in the upper tube 44. A metal quick disconnect member 60 (e.g., including two semi-circular clamping sections) is fastened to the bottom of the motor mount base plate 48 and includes a protrusion 62 that engages a slot 64 in the shaft sleeve (FIG. 2) in a manner known in the art. Thus, the member 60, when fastened to the bottom of the motor mount base plate, releasably grips the shaft sleeve. The member 60 is fastened to the motor mount base plate (and optionally the two sections of the member are fastened together), using fasteners. The lower end portion 28 of the shaft sleeve 24 is fastened near an upper surface of the base such as using cement. An optional gas and/or gas and flux, injection tube 66 known in the art may extend between the motor mount base plate 48 and the base 12 in communication with a discharge passageway 68 of the base (FIG. 2) in the example pump shown.

The through holes or openings in the shaft sleeve (e.g., 20*a*, 31 shown in FIGS. 1-4) may be present in various numbers, sizes shapes and positions. In one aspect shown in FIGS. 1-4 there are two sets of openings, the first (lower) openings 20*a* near a lower end portion of the shaft sleeve and the second (upper) openings 31 spaced vertically relative to the first openings. The second openings 31 may be positioned so as to be offset or rotated circumferentially around the shaft sleeve relative to the first openings 20*a* in a top cross-sectional plan view of the shaft sleeve (with a cutting plane perpendicular to the page of FIG. 2). In one possibility, the pressurized gas from the gas source would leave the shaft sleeve through the upper second openings 31 only, while molten metal would enter the shaft sleeve through the first openings 20*a* due to the rotation of the impeller or rotor in the impeller chamber. Molten metal may also enter through the lower inlet opening 20*c* of the base in the example top and bottom feed pump shown. It should be apparent to those skilled in the art in reading this disclosure that a dynamic action of forces occurs during pumping: that caused by the rotation of the impeller in the molten metal and that caused by the pressurized gas in the shaft sleeve.

It should be appreciated that conditions can vary during pumping, including the depth of the molten metal bath in which the base is submerged or depth of submerging of the base in the bath, the level of the molten metal inside the shaft sleeve, speed of the motor, changing flow of molten metal due to changing between use of the pump for discharge versus transfer etc. (in the case of a multi-functional pump). Therefore, this disclosure provides advantages by enabling control of the gas flow rate and/or pressure. For example, using a pressure regulator alone may be sufficient. Alternatively, using a pressure regulator and a downstream flow regulator may also be sufficient. One example of a gas flow regulator is 7520 and 7530 Series™ Acrylic Tube Flowmeter and inlet metering valve by King Instrument Company. An example of a pressure regulator and gauge is the 100 Silverline Series™ general purpose single state line regulator by Smith Equipment. At too high of gas pressure cavitation of the pump will occur which can lead to its destruction. At too low of gas pressure, the gas will not exit the shaft sleeve or not enough gas will exit the shaft sleeve, so that there is little effect in reducing dross formation in the bath.

Figure 5:
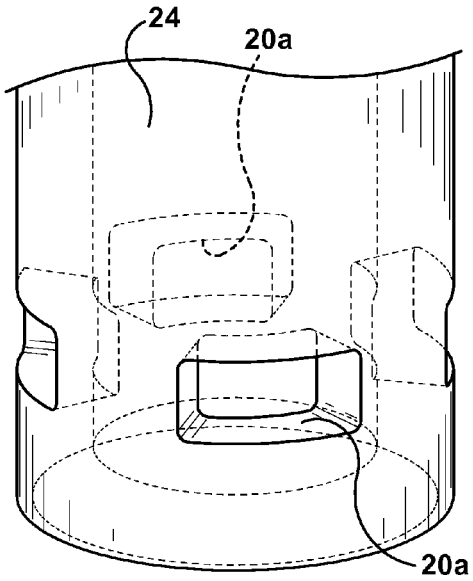

In a variation of the shaft sleeve 24 shown in FIG. 5, the openings 20*a* in the shaft sleeve 24 can be at similar or the same vertical position relative to each other. It might be possible to omit the upper openings 31. In this aspect, the openings 20*a* may have dual purposes. The level of molten metal in the shaft sleeve could be adjusted to permit gas to be outlet from the openings 20*a*. In addition, it might be possible for molten metal to also enter the openings 20*a*. For example, if the molten metal level inside the shaft sleeve is near the midpoint of the openings 20*a*, molten metal may enter and gas may leave the shaft sleeve through the same openings.

Figure 6:
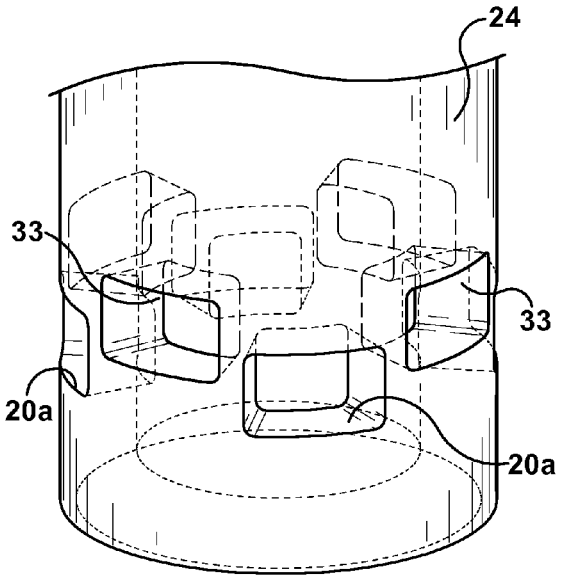

In yet another variation of the shaft sleeve 24 shown in FIG. 6, the openings include two or more sets of openings in which the first lower openings 20*a* are not completely vertically spaced apart from the second upper openings 33. That is, the upper second openings 33 are positioned to vertically overlap a region in which the lower first openings 20*a* are disposed. In one aspect, molten metal might enter the shaft sleeve 24 through the lower first openings 20*a* as well as through a lower portion of the second openings 33. In another aspect gas may be outlet through the upper second openings 33 entirely. Still further, gas may also be outlet though a portion of the first openings 20*a*.

While not wanting to be bound by theory it is believed that if the molten metal level inside the shaft sleeve is near an upper surface of the lower first openings 20*a*, so as to also be present about ¼ of the way upward from the bottom of the second upper openings 33, for example, when the first and second openings vertically overlap in a manner shown in FIG. 6, there may be molten metal inlet through both openings and gas outlet though the upper openings 33. The lower openings 20*a* may be predominantly for molten metal inlet while the upper openings 33 may be predominantly for gas outlet. Other variations of a proportion of gas outlet and molten metal inlet through the upper and lower openings may be possible as would be apparent to those skilled in the art in view of this disclosure. For example, gas might also leave the lower openings 20*a* and it may be the case that no molten metal enters through the upper openings 33.

Figure 7:
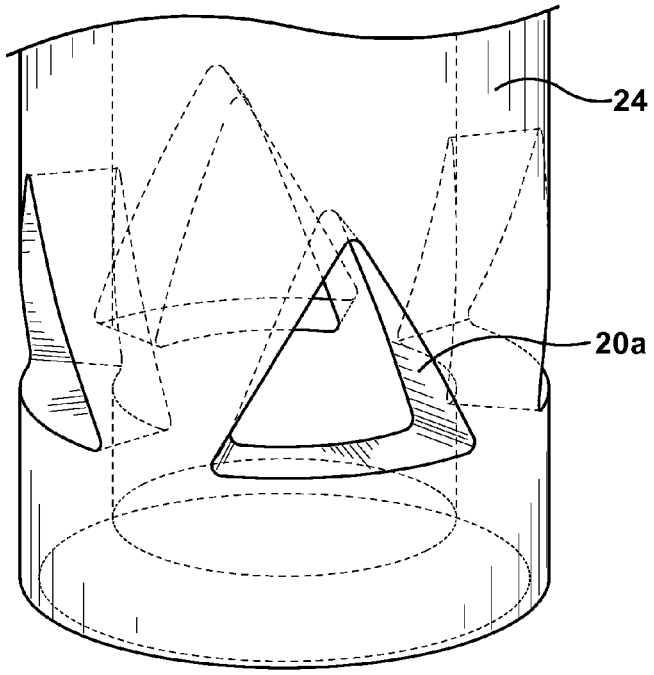
Figure 8:
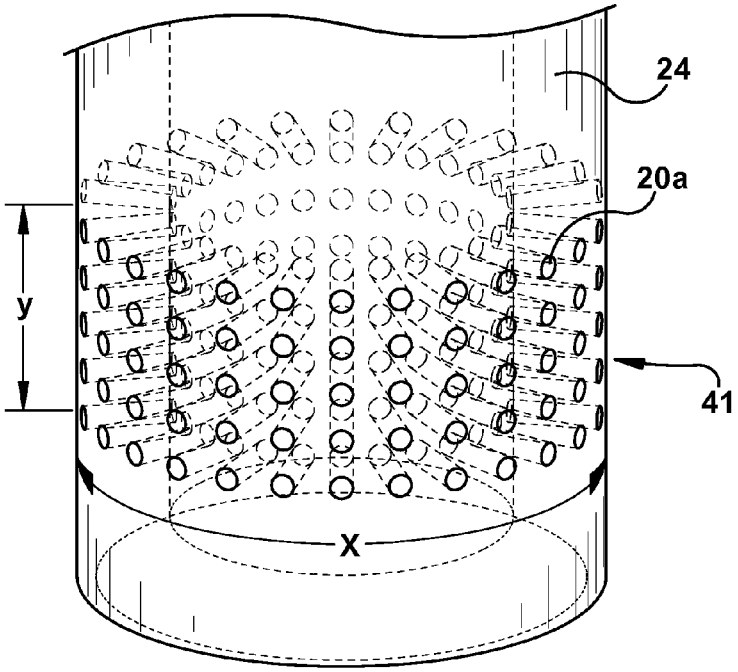

It should also be apparent that many variations are possible, such as in the shape, size and number of the openings, within the scope of this disclosure. The upper and lower openings might even communicate with each other. The openings might be much smaller for gas outlet compared to molten metal inlet. The openings can be various shapes such as round, rectangular or triangular, for example. Triangular openings 20*a* are shown in FIG. 7. It may be possible for molten metal to enter through the lower, larger area portions of the triangular openings and for the gas to be outlet from the shaft sleeve from the smaller area upper portions of the same triangular holes. In addition, rather than using holes of specific size for gas outlet and possibly another size for molten metal inlet, a plurality of holes 20*a* can be used as shown in FIG. 8. These holes may be in a uniform pattern or not. The molten metal being inlet into the shaft sleeve, if any, and the gas being outlet from the shaft sleeve can then "see" the appropriate location and area of holes suitable for one or the other or both of these purposes. The vertical extent of the openings 20*a* may be at least 50% greater than that of ordinary openings used in conventional shaft sleeves (e.g., in U.S. Pat. No. 5,676,520) and the holes as illustrated here each have a much smaller area than such conventional openings. In the example shown in FIG. 8 the openings 20*a* all have the same size and shape and are disposed in a region 41 for a circumferential distance x partially or completely around the shaft sleeve extending for a vertical distance y in a longitudinal direction of the shaft sleeve. The size and location of the region 41 on the shaft sleeve containing the openings 20*a* is appropriate to where the molten metal level can be inside the shaft sleeve so as to be suitable for pumping and reducing the formation of dross in the bath. The plurality of openings 20*a* shown in FIG. 8 can also be larger in size (e.g., diameter) at a lower portion of the region 41 if it is desired to have more molten metal inlet capacity, for example.

The upper tube 44 is disposed above the refractory shaft sleeve 24. The upper tube 44, the motor mount base plate 48, the motor adapter plate 50 and the motor 30 form an enclosure about the upper end portion 26 of the shaft sleeve 24 (i.e., about its cylindrical passageway 27 at its upper end portion) so that it can be pressurized. Optional gaskets may be used for sealing as appropriate. The gas source 36 can apply pressurized gas to the molten metal 14 inside the shaft sleeve 24 to lower a level of the molten metal inside the shaft sleeve such as to locations 70*a* or 70*b* (FIG. 3). The regulator 41 of the flow rate and/or pressure of the gas can be used to maintain a certain height of the molten metal inside the shaft sleeve and flow of gas out the shaft sleeve and prevent cavitation of the pump, which has not previously been possible with such pumps, even those that flow gas inside the shaft sleeve. Not having such control over pressure and/or flow rate of the gas prevents these prior pumps from pumping enough gas into the bath that significantly prevents dross formation in the bath. For example, such prior pumps may not flow enough gas into the bath that significantly prevents dross formation by having the gas function as a cover gas at or near the surface of the bath. For example, referring to FIG. 4, the molten metal 45 inside the shaft sleeve may be above the first openings 20*a* of the shaft sleeve but below the second openings 31 of the shaft sleeve, at a location which does not result in cavitation of the pump. When the molten metal level inside the shaft sleeve falls below the lower surface of the lower openings 20*a* the pump is at risk of cavitation. The upper tube 44 can include a port 74 and optional second port 76. The gas 37 (represented by dots in FIG. 3) travels from the gas source 36 along the conduit 40*b* from the gas regulator 41 into the upper tube 44 through the port 74. The conduit 40*b* can be fastened to the port 72 via a fitting shown generally at 78 in FIG. 3 (e.g., a threaded connection between the conduit and port). The pump can be operated by applying gas continuously or periodically. The ports or closable window 76 in the upper tube 44, when opened, can permit one to access the coupling 58 with tools.

Any molten metal can be processed according to the present disclosure but particular examples are aluminum, magnesium and zinc. In particular, gas 37 flows into the conduit 40*a*, through the gas regulator, through the conduit 40*b* and into the upper tube 44. The gas 37 travels from the upper tube 44 down the inside the passageway 27 of the shaft sleeve 24. The gas 37 can comprise any suitable gas, for example, it can comprise or consist essentially of inert gas such as nitrogen or argon. A suitable gas pressure can be in a range of 0 to 5 psi, for example, and in particular, from 1 to 5 psi, for molten aluminum. One suitable pressure is that which displaces the molten metal inside the shaft sleeve to a location near a lower portion of the shaft sleeve but without cavitation, plus 20% more of this pressure. The pressure can be regulated. Pressures higher than 5 psi may be used when pressurizing the shaft sleeve in connection with molten metal such as zinc having a higher density than molten aluminum. Moreover, gas flow rate can also be regulated. A suitable gas flow rate is regulated in a range of 15-180 SCFH. The regulator will select a suitable gas flow rate and/or pressure and maintain this despite varying conditions during pumping so as to avoid cavitation and outlet enough gas that substantially reduces dross formation in the bath.

In one specific variation shown in the drawings, the outlet 22 includes the discharge passageway 68 leading from the impeller chamber 18 to an exterior surface 19 of the base enabling the pump to circulate the molten metal 14 through a vessel 16. However, in another specific variation, the outlet 22 can communicate with a riser tube enabling the molten metal to be transferred to another location. For example, the base is submerged in a vessel, such as a pump well, that communicates with a furnace. Still further, the pump can be constructed and arranged to carry out circulation, transfer, and/or circulation and transfer, of the molten metal metal 14. For example, this can be achieved with the multifunctional Chameleon® pump manufactured by High Temperature Systems, Inc., which can circulate, transfer, or both at the same time or different times and even transfer to multiple locations at the same or different times all with the same pump, which is incorporated herein by reference suitable for modification so as utilize the embodiments of this disclosure.

The shaft 32 is driven by operating the motor 30 (rotating the drive shaft 52), which rotates the impeller 34 in the impeller chamber 18. The gas 37 flows from the gas source 36 into the shaft sleeve 24 under pressure so as to lower the molten metal 45 inside the shaft sleeve 24 (the molten metal 45 being shown by cross hatching) to a desired level (e.g., 70*a* or 70*b* of FIG. 3). Rotation of the impeller 34 causes the molten metal 14 to enter the shaft sleeve lower openings 20*a*, for example, as shown by the long arrows of FIG. 3 and then to travel as molten metal 45 inside the shaft sleeve into the impeller chamber 18 and from the outlet 22 into the molten metal bath 14 in which the base 12 is submerged in vessel 16. This circulates the molten metal from the bath in which the pump is situated to the vessel in communication with it.

In another variation the outlet communicates with a riser tube, and the molten metal is passed from the outlet, through the riser tube and then to another location. The pump can carry out one or more of circulating, transferring, and circulating and transferring, the molten metal or the molten metal and the flux, using the pump.

The gas source 36 is connected to the pump and flows gas into the upper tube 44 and the shaft sleeve 24 under pressure. This pressurizing occurs using pressurized gas due to the upper open end of the shaft sleeve being enclosed. The pump shaft 32 is driven by the motor so as to rotate the impeller 34 in the impeller chamber 18. Upper and lower bearing rings

80*a*, 80*b*, respectively, on the impeller 34 are disposed to rotate inside upper and lower bearing rings 82*a*, 82*b*, respectively, fastened to the base 12 (FIG. 3). These bearing rings may be formed of abrasion resistant ceramic as known in the art. The engagement of the bearing rings 80*a*, 82*a* and 80*b*, 82*b*, centers the impeller 34 for rotation inside the impeller chamber 18.

The impeller 34 may be a top feed, a bottom feed or a top and bottom feed impeller, as known in the art. If a top feed impeller is used, the lower opening 20*c* in the base can be omitted or it can remain but the lower impeller openings 88 would be omitted and the impeller could have an imperforate lower plate blocking the opening 20*c*. In the example top and bottom feed impeller (FIG. 3), the molten metal enters the impeller chamber through the openings 88 in the bottom of the impeller, the impeller being situated so as to partially block a lower opening 86 in the base. The lower bearing ring 82*b* fastened to the base can be disposed so as to delimit the lower opening 86. The impeller also includes upper impeller openings 90 as is known in the art for a top and bottom feed impeller by High Temperature Systems, Inc.

If a bottom feed impeller is used, the impeller chamber is still in fluid communication with the inside of the shaft sleeve, but the rotor or impeller would not be designed to draw molten metal through the shaft sleeve openings. The molten metal would however, be disposed inside the shaft sleeve. In this case, the openings in the shaft sleeve could primarily or entirely function for outlet of gas from the shaft sleeve. The impeller chamber 18 may include a volute member or be formed in a shape of a volute, or not, as known in the art. The submerged discharge pump example shown in the drawings is operated to circulate the molten metal from the bath of molten metal in which the pump is situated, through a furnace.

The gas 37 flows into the upper tube 44 and the shaft sleeve 24 at a pressure and/or flow rate which lowers a height of the molten metal 45 to a height 70 (e.g., 70*a* or 70*b*) inside of the shaft sleeve 24. That is, the pressurized gas forces the molten metal 45 lower in the shaft sleeve than it would ordinarily be while the motor is operating (and even while the motor is off). The gas may enter through the port 74 of the upper tube 44 or elsewhere in the pump in a variation of the pump design shown in the drawings. For example, the gas 37 might be fed directly into the refractory shaft sleeve 24 using suitable heat resistant conduit between the gas source 36 and shaft sleeve 24.

The pressurized gas 37 inside the shaft sleeve 24 may keep it cleaner than if molten metal occupied a greater height in the shaft sleeve.

While not wanting to be bound by theory, gas is expected to leave the shaft sleeve in an amount that reduces dross formation in the molten metal bath. This may be achieved, for example, by the gas 37 leaving the shaft sleeve such as in a manner shown by the upper smaller arrows in FIG. 3, through the upper openings 31, upward toward a surface of the bath. This gas may form a layer 94 of cover gas at or near the surface of the bath. It is believed this cover layer of gas, being inert, will reduce formation of oxides of the molten metal, which reduces formation of dross composed of these oxides.

Gas and/or flux may also be delivered along the feeding tube 66 extending between the motor mount and the base in communication with the discharge passageway as shown in FIG. 3 and known in the art.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A pump for pumping molten metal comprising:

a refractory base that can be submerged in a bath of molten metal;

a refractory shaft sleeve having upper and lower end portions and being fastened to said base at the lower end portion, wherein said shaft sleeve is enclosed at the upper end portion, said shaft sleeve including openings at a lower end portion;

wherein said base includes an impeller chamber that is in fluid communication with said shaft sleeve and includes an outlet from the impeller chamber;

a motor;

a refractory shaft extending in said shaft sleeve and connected to said motor;

a refractory impeller connected to said shaft and rotatable in said impeller chamber of said base;

a gas source that flows gas comprising inert gas into said shaft sleeve under pressure;

a regulator that regulates at least one of flow rate and pressure of said gas while outletting said gas through said openings of said shaft sleeve; and a plurality of said openings disposed in a region of said shaft sleeve that extends partially or completely around a circumference of said shaft sleeve for a vertical distance of said shaft sleeve, whereby the molten metal is drawn via the rotating impeller into said shaft sleeve through said openings in a first lower portion of said region and the gas is outlet from said shaft sleeve into the molten metal through said openings in a second upper portion of said region.

2. The pump of claim 1 wherein said openings include first openings located near said base and second openings, wherein upper surfaces of said second openings are disposed above upper surfaces of said first openings.

3. The pump of claim 1 wherein said regulator regulates said gas so that said gas that is outlet from said shaft sleeve through said openings travels into said bath so as to form a cover layer of inert gas on or near the surface of the bath that reduces formation of dross in said bath.

4. The pump of claim 2 wherein said first openings are inlet openings through which molten metal enters said shaft sleeve and said second openings are outlet openings through which said gas is outlet from said shaft sleeve.

5. The pump of claim 2 wherein said second openings are constructed and arranged so as to be completely above said first openings with a vertical space between said first and second openings.

6. The pump of claim 2 wherein said second openings are constructed and arranged so as to overlap said first openings.

7. The pump of claim 1 wherein said impeller is a top feed impeller, a bottom feed impeller or a top and bottom feed impeller.

8. The pump of claim 1 including an opening in a bottom of said base that is partially blocked by said impeller so that the molten metal enters said impeller chamber through openings in said impeller.

9. The pump of claim 1 wherein said regulator maintains said molten metal inside said shaft sleeve at a desired level despite changing conditions selected from the group consisting of: level of submergence of said base in the bath, level of molten metal in the bath, speed of the motor and combinations thereof.

10. The pump of claim 1 wherein said openings have a uniform size or shape.

11. The pump of claim 1 wherein said openings have different sizes than each other.

12. The pump of claim 1 wherein each of said openings includes an upper portion and a lower portion, the upper portion having a smaller area than the lower portion, wherein the gas is outlet from said shaft sleeve through the upper portion and the molten metal enters the shaft sleeve through the lower portion.

13. The pump of claim 1 wherein said regulator regulates at least one of flow rate and pressure of said gas so as to avoid cavitation of the pump while outletting said gas through said openings of said shaft sleeve.

14. The pump of claim 1 wherein said regulator regulates the flow rate and the pressure of said gas.

15. The pump of claim 7 wherein said impeller is a top feed impeller.

16. A method of operating a pump for pumping molten metal, said pump comprising: a refractory base that is submerged in a bath of molten metal; a refractory shaft sleeve having upper and lower end portions and being fastened to said base at the lower end portion, wherein said shaft sleeve is enclosed at the upper end portion, said shaft sleeve including openings located at said lower end portion; wherein said base includes an impeller chamber that is in fluid communication with said shaft sleeve and includes an outlet from the impeller chamber; a motor; a refractory shaft extending in said shaft sleeve and connected to said motor; a refractory impeller connected to said shaft and rotatable in said impeller chamber; a gas source that flows gas comprising inert gas into said shaft sleeve under pressure, said method comprising:

submerging the base in a bath of molten metal;

operating said motor so as to rotate said impeller via said shaft;

moving molten metal into said impeller chamber and from the outlet of said base as a result of said impeller rotating in said impeller chamber;

flowing said gas down said shaft sleeve;

regulating at least one of flow rate and pressure of said gas while outletting said gas through said openings in said shaft sleeve; and a plurality of said openings disposed in a region of said shaft sleeve that extends partially or completely around a circumference of said shaft sleeve for a vertical distance of said shaft sleeve, comprising drawing the molten metal via the rotating impeller into said shaft sleeve through the openings in a first lower portion of said region and moving the gas out said shaft sleeve into the molten metal through the openings in a second upper portion of said region.

17. The method of claim 16 wherein the regulation of said gas that outlets said gas through said openings in said shaft sleeve reduces dross formation in said bath.

18. The method of claim 17 wherein said dross formation is reduced by outletting said gas into said bath effective to form a cover layer of said gas on or near a surface of said bath that reduces the formation of dross in said bath.

19. The method of claim 16 wherein said openings in said shaft sleeve include first openings located near said base and second openings, wherein upper surfaces of said second openings are disposed above upper surfaces of said first openings, including feeding the molten metal into said shaft sleeve through said first openings and outletting said gas from said shaft sleeve through said second openings.

20. The method of claim 19 wherein the regulation of said gas causes a level of molten metal inside said shaft sleeve to be located below the upper surface of said second openings.

21. The method of claim 16 wherein the regulation of said gas maintains the molten metal inside the shaft sleeve at a desired level despite changing conditions selected from the group consisting of: level of submergence of the base in the bath, level of molten metal in the bath, speed of the motor and combinations thereof.

22. The method of claim 19 wherein said second openings are constructed and arranged so as to be completely above and vertically spaced apart from said first openings.

23. The method of claim 19 wherein said second openings are constructed and arranged so as to overlap said first openings.

24. The method of claim 16 wherein said openings have a uniform size and shape.

25. The method of claim 16 wherein said openings have different sizes than each other.

26. The method of claim 16 wherein each of said openings includes an upper portion and a lower portion, the upper portion having a smaller area than the lower portion, comprising outletting the gas from said shaft sleeve through the upper portion and flowing the molten metal into the shaft sleeve through the lower portion.

27. The method of claim 16 wherein said regulator regulates at least one of flow rate and pressure of said gas so as to avoid cavitation of the pump while outletting said gas through said openings of said shaft sleeve.

28. The method of claim 16 wherein said regulator regulates the flow rate and the pressure of said gas.

29. A pump for pumping molten metal comprising:

a refractory base that can be submerged in a bath of molten metal;

a refractory shaft sleeve having upper and lower end portions and being fastened to said base at the lower end portion, wherein said shaft sleeve is enclosed at the upper end portion, said shaft sleeve including openings at a lower end portion;

wherein said base includes an impeller chamber that is in fluid communication with said shaft sleeve and includes an outlet from the impeller chamber;

a motor;

a refractory shaft extending in said shaft sleeve and connected to said motor;

a refractory impeller connected to said shaft and rotatable in said impeller chamber of said base;

a gas source that flows gas comprising inert gas into said shaft sleeve under pressure;

a regulator that regulates at least one of flow rate and pressure of said gas while outletting said gas through said openings of said shaft sleeve;

wherein said openings include first openings located near said base and second openings, wherein upper surfaces of said second openings are disposed above upper surfaces of said first openings;

wherein said second openings are positioned so as to be circumferentially offset from said first openings in a top cross-sectional view.

* * * * *